US005449007A

United States Patent [19]

Arnhols

[11] Patent Number: 5,449,007

[45] Date of Patent: Sep. 12, 1995

[54] HAIR COMB WITH MOVEABLE GRIPPING ELEMENTS

[76] Inventor: Bertie I. Arnhols, 101 Twilight Dr., Cary, N.C. 27513

[21] Appl. No.: 249,613

[22] Filed: May 26, 1994

[51] Int. Cl.[6] ..... A45D 24/04; A45D 24/08; A45D 24/38

[52] U.S. Cl. ..... 132/136; 132/143; 132/144

[58] Field of Search ..... 132/144, 143, 129, 136, 132/138, 155, 281, 282, 283, 284; 24/523, 528

[56] References Cited

U.S. PATENT DOCUMENTS

| | | | |
|---|---|---|---|
| 999,596 | 8/1911 | Schärer | 132/136 |
| 1,197,264 | 9/1916 | Cobb | 132/136 |
| 1,614,631 | 1/1927 | Sendlbeck | 132/136 |
| 2,533,067 | 12/1950 | Taren et al. | 132/155 |
| 3,088,471 | 5/1963 | Fiore | 132/136 |

FOREIGN PATENT DOCUMENTS

| | | | |
|---|---|---|---|
| 805426 | 3/1951 | Germany | 132/138 |

*Primary Examiner*—John G. Weiss

*Assistant Examiner*—Elise P. Speaks

*Attorney, Agent, or Firm*—Rhodes, Coats & Bennett

[57] ABSTRACT

A hair comb includes moveable gripping elements for securing the hair comb in place in the user's hair. The hair comb comprises a main body including a plurality of teeth. A selected number of teeth include a longitudinal channel which is open along one side of the tooth. A gripping member including one or more gripping teeth is movably mounted in the main body. The gripping member is moveable from an inoperative position in which the gripping teeth are disposed within the longitudinal channels of respective teeth of the main body and a clamping position in which the gripping teeth extend outwardly from the longitudinal channels to clamp the user's hair between the gripping teeth and the adjacent teeth. A resilient member urges the gripping member to the retracted position. A latch releasably locks the gripping member in a clamping position. In a preferred embodiment of the invention, the latch is operative to lock the gripping members in a plurality of different positions.

18 Claims, 4 Drawing Sheets

HAIR COMB WITH MOVEABLE GRIPPING ELEMENTS

BACKGROUND OF THE INVENTION

The present invention relates generally to a hair comb for holding the user's hair in place and, more particularly, to a hair comb having gripping elements to prevent the hair comb from dislodging from the user's hair.

Hair combs are used by women to secure their hair in a predetermined arrangement. A hair comb typically comprises a back and a plurality of fixed teeth which are inserted into the user's hair. In theory, the teeth of the comb grip the user's hair to retain the hair and the comb in place. In actual practice, however, combs having fixed teeth do not hold their position well and are easily dislodged. For this reason, bobby pins are frequently used to secure the hair comb in place.

In the past, it has been proposed to incorporate gripping elements into a hair comb to secure the hair comb in place. For example, hair combs having gripping elements are disclosed in the patents to Marini, U.S. Pat. No. 2,456,138; Leibert, U.S. Pat. No. 2,479,631; Hertz, U.S. Pat. No. 2,530,612; and Cartheuser, U.S. Pat. No. 2,596,207. Also of interest are the patents to Watson, U.S. Pat. No. 842,733; and Leonard, U.S. Pat. No. 871,422.

The patents to Liebert, U.S. Pat. No. 2,479,631 and Cartheuser, U.S. Pat. No. 2,596,207 disclose hair combs having one set of fixed teeth and a second set of moveable teeth. The user's hair is clamped between the fixed teeth and the moveable teeth. In each of these patents, the moveable teeth are biased to a closed position. The biasing member applies a predetermined gripping force which cannot be varied by the user.

The patent to Marini, U.S. Pat. No. 2,456,138, discloses a hair comb having a first set of fixed teeth and a second set of rotatable blade-like teeth. The blade-like teeth are connected to a moveable bar. When the bar is moved longitudinally, the blade-like teeth rotate from an open position to a closed position to clamp the user's hair.

The patent to Hertz, U.S. Pat. No. 2,530,612 discloses a hair comb having a set of fixed teeth and a plurality of smaller serrated teeth mounted on a moveable bar. When the serrated teeth are in a retracted position, the hair of the user can pass freely into the openings between the fixed teeth. The serrated teeth can be moved to an extended position in which the serrations engage the hair to secure the comb in place.

The patent to Watson, U.S. Pat. No. 842,733, discloses a comb having a set of hollow teeth. A U-shaped bow is disposed within the hollow teeth. The U-shaped bow includes a set of upwardly projecting spikes. When the bow is deformed by applying pressure to the bow, the spikes retract into the hollow teeth. The spikes return to an extended position when the pressure on the bow is removed.

The patent to Leonard, U.S. Pat. No. 871,422, discloses a hair pin having a pair of retractable spurs for engaging the hair.

None of the cited references has gained commercial acceptance. The failure of these prior art devices to gain commercial acceptance reflects inherent disadvantages of those devices. Some of those disadvantages include complicated structures which are costly to produce, structures that snag the user's hair, and the inability to vary the gripping force applied by the gripping element.

SUMMARY AND OBJECTS OF THE INVENTION

The present invention is a hair comb having gripping elements for securing the hair comb in place in the user's hair. The hair comb comprises a main body having a plurality of hollow teeth. Each of the hollow teeth include a closed side and an open side. A gripping member is slidably mounted in the main body and includes a plurality of gripping teeth. The gripping member is moveable between an inoperative position and a clamping position.

When the gripping member is in an inoperative position, the gripping teeth are received inside respective hollow teeth of the main body. Conversely, when the gripping member is moved to the clamping position, the gripping teeth extend outwardly from the hollow teeth through the open side thereof to clamp the user's hair between the gripping teeth and the closed side of the adjacent teeth. The gripping member is biased to an inoperative position and a releasable latch secures the gripping teeth in a clamping position. In a preferred embodiment of the invention, the releasable latch is operative to secure the gripping member in more than one position so that the user can selectively vary the amount of clamping force applied by the gripping teeth.

The hair comb of the present invention can be used advantageously in place of conventional hair combs with fixed teeth. The hair comb grips the user's hair so that the chance of the hair comb becoming dislodged is greatly reduced. The gripping elements are designed to avoid snagging and pulling of the user's hair, and to be comfortable when used. The hair comb of the present invention has relatively few components and is easy to use. The small number of components also reduces the cost of manufacture of the hair comb.

Other objects and advantages of the present invention will become apparent and obvious from a study of the following description and the accompanying drawings which are merely illustrative of such invention.

DETAILED DESCRIPTION OF THE INVENTION

Figure 1:
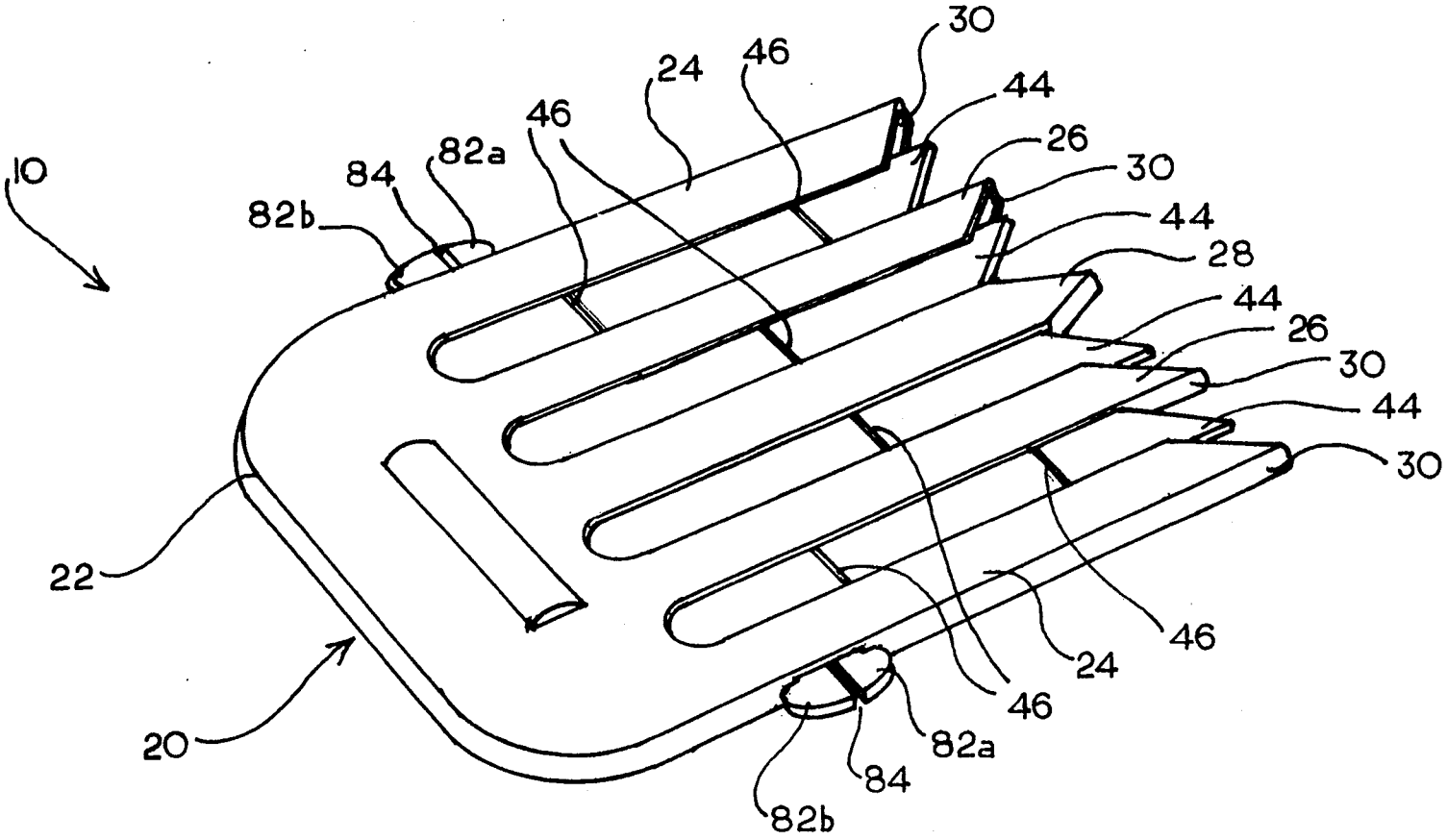
FIG. 1 is a perspective view of the hair comb of the present invention.
Figure 2:
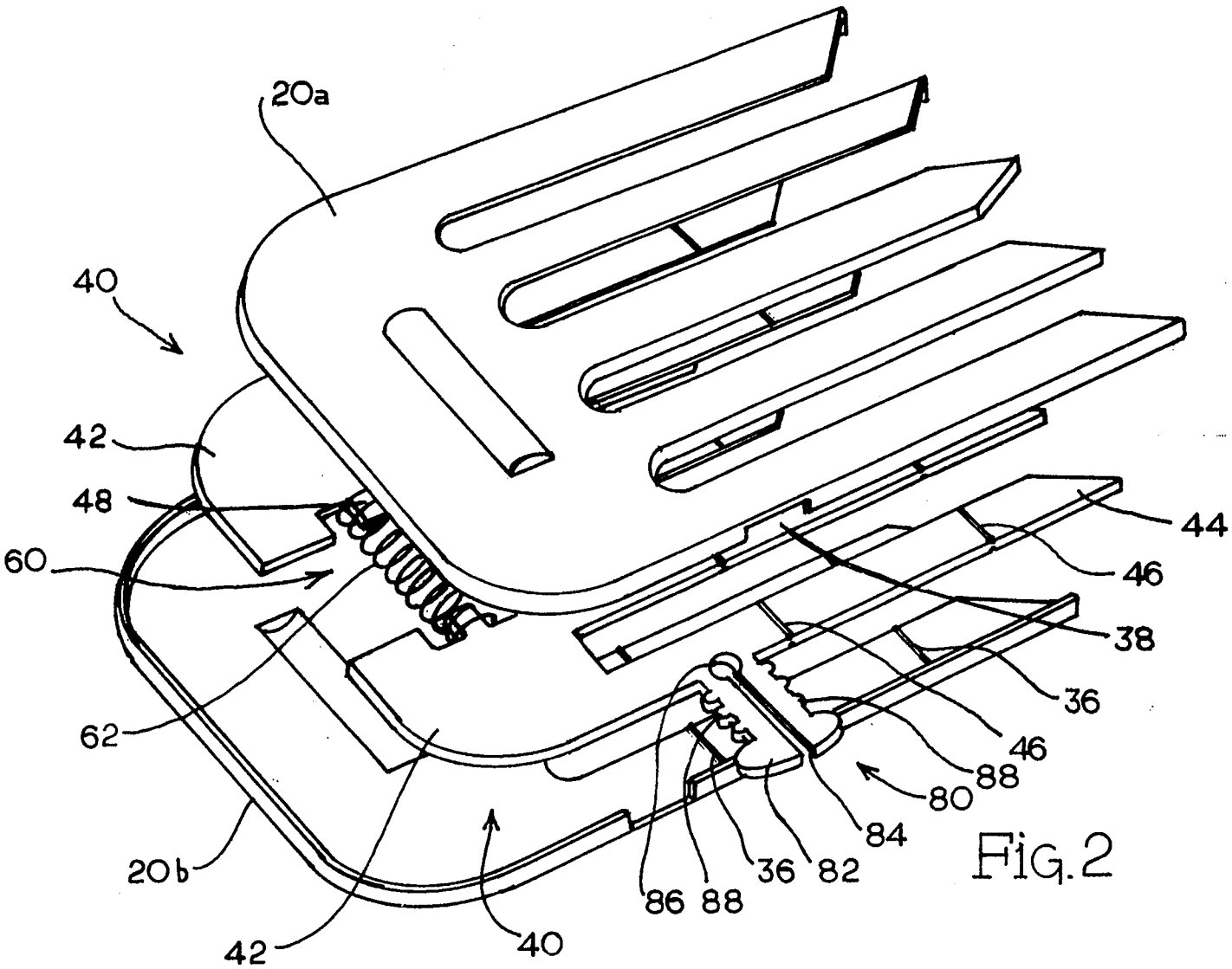
FIG. 2 is an exploded perspective view of the hair comb.

Referring now to the drawings, and particularly to FIGS. 1 and 2, the hair comb of the present invention is shown therein and indicated generally by the numeral 10. The hair comb 10 generally comprises a main body 20, a pair of gripping elements 40 movably mounted on the main body 20, a biasing member 60 for urging the moveable gripping elements 40 to an inoperative position, and a force applying member 80 which includes a releasable latch for securing the moveable gripping elements in a clamping position. The main body 20 includes a back portion 22 and a plurality of teeth including two outer teeth 24, two intermediate teeth 26, and a center tooth 28. The outer teeth 24 and intermediate teeth 26 have a generally c-shaped cross-section having one closed side and one open side. Both sides of the center tooth 28 are closed. The closed sides of the intermediate teeth 26 and the center tooth 28 provide a clamping surface 30 for clamping the user's hair as will be described below.

The main body 20 is formed by joining two identical sections 20*a* and 20*b* together. The top and bottom sections 20*a* and 20*b* may be joined by any suitable means, such as ultrasonic welding. Prior to joining the sections 20*a* and 20*b* together, the gripping members 40 are inserted between the two sections and the biasing member 60 is inserted between the gripping members 40. After the two sections 20*a* and 20*b* are joined, the gripping members 40 and biasing member 60 are enclosed in the main body 20.

Figures 3, 4:
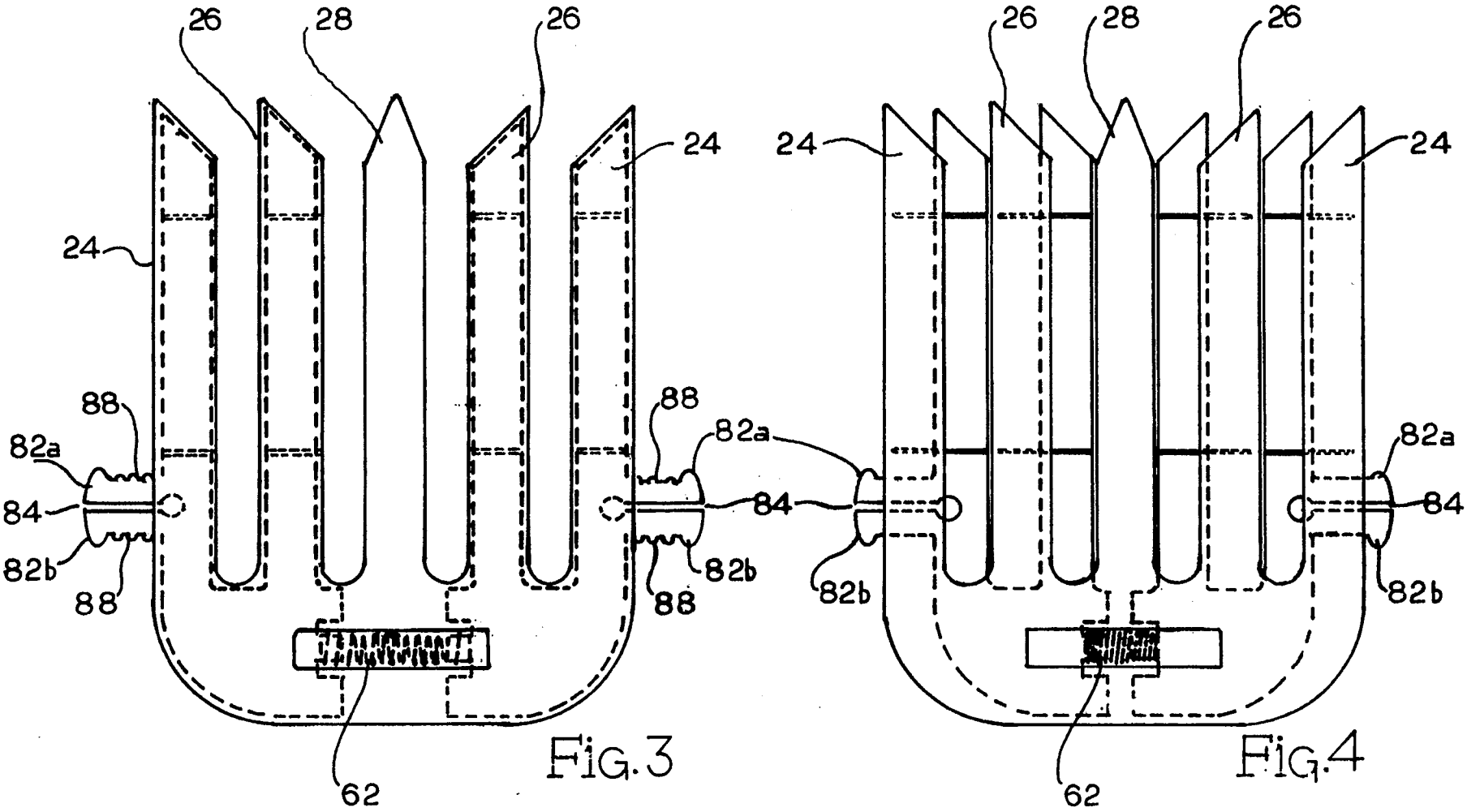
FIG. 3 is a plan view of the hair comb with the gripping elements in an inoperative position.
FIG. 4 is a plan view of the hair comb with the gripping elements in a clamping position.
Figure 5:
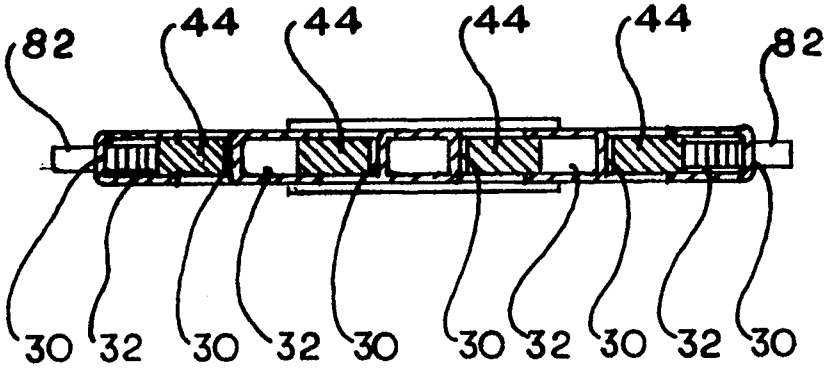
FIG. 5 is a cross-section of the hair comb taken through the teeth of the comb.

The gripping member 40 comprises a generally planer member having a back portion 42 and a pair of gripping teeth 44. The gripping members 40 are moveable between an inoperative position (FIG. 3) and a clamping position (FIG. 4). When the gripping members 40 are in the inoperative position, the gripping teeth 44 are received within the longitudinal channels 32 of the intermediate teeth 26 and outer teeth 24 as shown most clearly in FIGS. 3 and 5. Conversely, when the gripping members 40 are moved to the clamping position, the gripping teeth 44 extend through the open side of the longitudinal channel 32 to clamp the user's hair against the clamping surface 30 of an adjacent tooth as shown in FIG. 4.

Grooves 46 are formed in the surface of the gripping teeth 44 in order to maintain proper alignment of the gripping teeth 44 as they move from their inoperative position to their clamping position. Corresponding guide ribs 36 are formed in the top and bottom sections 20*a* and 20*b* of the main body 20. The guide ribs 36 in the main body 20 slide in respective grooves 46 on the gripping teeth 44 to keep the gripping teeth 44 aligned.

The gripping members 40 are biased to an inoperative position by a biasing member 60. In the disclosed embodiment, the biasing member is a resilient member, such as a compression spring 62, which is disposed between the gripping members 40. The spring 62 urges the gripping members 40 away from one another. A pair of spring tabs 48 are formed on the gripping members 40 to hold the spring 62 in place. The spring tabs 48 extend into the opposing ends of the spring 62.

A force applying member 80 is used to move the gripping members 40 to the clamping position. In the disclosed embodiment, the force-applying members 80 comprise a pair of finger tabs 82 which are integrally formed with the gripping members 40. The finger tabs 82 extend through side openings 38 in the main body 20 where they can be manually pressed between the user's thumb and index finger. When the finger tabs 82 are pressed, the gripping members 40 are moved inwardly against the force of the spring 62 to a clamping position. A releasable latch integral with the finger tabs 82 automatically engages to retain the gripping members 40 in the clamping position.

In the disclosed embodiment, the finger tabs 82 are designed to also function as a latch. It is understood, however, that the latch may comprise a separate element independent of the finger tabs 82. As shown in FIG. 2, the finger tabs 82 include a slot 84 which terminates in a relief opening 86. The slot 84 divides the finger tabs 82 into two half portions 82*a* and 82*b* which can be deformed by squeezing the two portions together. The sides of the finger tabs 82 include rounded detents 88 which are spaced from one another. The detents 88 engage the edges of the side openings 38 in the main body 20 to secure the gripping members 40 in the clamping position. To release the gripping members 40, the half portions 82*a* and 82*b* of the finger tabs 82 are pressed together. When the finger tabs 82 are pressed together, the spring 62 automatically urges the gripping members 40 to the inoperative position.

In use, the hair comb 10 is held with the thumb and index finger on opposite finger tabs 82. The teeth of the hair comb 10 are then inserted into the user's hair. While the hair comb 10 is being inserted, the gripping members 40 are urged to the inoperative position by the spring 62. After insertion of the hair comb 10 into the user's hair, the gripping members 40 are moved to the clamping position by squeezing the finger tabs 82 between the user's thumb and index finger. As pressure is applied to the finger tabs 82, the gripping members 40 move inwardly towards one another. Pressure is applied until the hair is firmly clamped between the gripping teeth 44 and the clamping surface 30 of an adjacent tooth. The spaced apart detents 88 provide multiple clamping positions so that the user can select the desired amount of clamping force to be applied. To remove the hair comb 10, respective finger tabs 82 are gripped in each hand and are squeezed together to bend the half portions 82*a* and 82*b* inwardly. As the finger tabs are deformed, the detents 88 disengage from the edges of the side opening 38 in the main body 20 and the spring 62 urges the gripping members 40 back to the inoperative position.

From the foregoing, it is apparent that the hair comb 10 of the present invention provides a hair comb having moveable gripping elements which is relatively easy to use and has few components. The gripping elements 40 provide a more reliable method for securing the hair comb 10 in place in the user's hair. Further, the hair comb 10 of the present invention allows the user to select the desired amount of clamping force to be applied.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A hair comb for holding a user's hair in place comprising:

(a) a main body including a plurality of hollow teeth having a closed side and an open side;

(b) a plurality of gripping elements normally disposed in an inoperative position inside the respective hollow teeth of the main body, wherein said gripping elements are moveable to a clamping position in which the gripping elements extend outwardly from the hollow teeth through the open side thereof to clamp the user's hair between the gripping elements and the closed side of adjacent teeth; and (c) a releasable latch operatively connected between the gripping elements and the main body to secure the gripping elements in a clamping position.

2. The hair comb of claim 1 further including a force-applying member disposed to apply a force to the gripping elements to move the gripping elements from the inoperative position to the clamping position.

3. The hair comb of claim 2 wherein the force-applying member is a finger tab connected to the gripping elements and disposed in a position to be manually pressed by the user.

4. The hair comb of claim 1 further including a biasing member disposed to urge the gripping elements to an inoperative position.

5. The hair comb of claim 1 further includes first and second guide elements formed respectively on the gripping elements and the main body, wherein the first and second guide elements cooperate to guide the gripping elements as they move from the inoperative position to the clamping position.

6. The hair comb of claim 5 wherein the first guide element comprises a groove formed in the gripping elements, and wherein the second guide element comprises a guide rib formed in the main body, said guide ribs being received for sliding movement in respective grooves on the gripping element.

7. The hair comb of claim 1 wherein the latch includes a flexible latch member operatively connected between the gripping element and the main body.

8. The hair comb of claim 7 wherein the latch member includes a plurality of detents for engaging the main body at a plurality of different positions.

9. A hair comb for holding a user's hair in place comprising:

(a) a main body including a plurality of teeth, wherein a selected number of teeth include a longitudinal channel which is open along one side of the tooth;

(b) a gripping member including a gripping tooth movably mounted in said main body, said gripping member being moveable from an inoperative position in which the gripping tooth is disposed within the longitudinal channel of a tooth of the main body and a clamping position in which the gripping tooth extends outwardly from the longitudinal channel towards an adjacent tooth of the main body to clamp the user's hair between the gripping tooth and the adjacent tooth;

(c) a resilient member engaged with the gripping member and disposed to urge the gripping member to the inoperative position; and (d) a latch operatively connected between the gripping member and the main body to hold the gripping member in a clamping position, the latch including a plurality of detents to releasably lock the gripping member in a plurality of different positions.

10. The hair comb of claim 9 further including a force-applying member disposed to apply a force to the gripping member to move the gripping member from the inoperative position to the clamping position.

11. The hair comb of claim 10 wherein the force-applying member is a finger tab connected to the gripping member and disposed to be manually pressed by the user.

12. The hair comb of claim 9 further includes first and second guide elements formed respectively on the gripping member and the main body, wherein said first and second guide elements cooperate to guide the gripping member as it moves from the inoperative position to the clamping position.

13. The hair comb of claim 12 wherein the first guide element comprises a groove formed in a gripping tooth, and wherein the second guide element comprises a guide rib formed in the main body, said guide rib being received in the groove on the gripping tooth.

14. A hair comb for holding a user's hair in place comprising:

(a) a main body including a plurality of teeth, including a central tooth having two closed sides, and a plurality of lateral teeth having an open side and a closed side, the lateral teeth disposed on either side of the central tooth, wherein the open side of said lateral teeth face a closed side of an adjacent tooth;

(b) a pair of opposed gripping members each of which includes a gripping tooth, wherein the gripping members are moveable from an inoperative position in which the gripping tooth is received in a lateral tooth to a clamping position in which the gripping tooth extends outwardly through an open side of a lateral tooth to clamp the user's hair between the gripping tooth and the closed side of the adjacent tooth;

(c) a resilient biasing member disposed to urge the gripping members to their inoperative position;

(d) a force-applying member disposed to apply a force to a gripping member to move the gripping member from an inoperative position to a clamping position; and (e) a releasable latch connected to each gripping member and engagable with the main body to secure the gripping member in a clamping position.

15. The hair comb of claim 14 wherein the force-applying member is connected to the gripping member and disposed in a position to be manually pressed by the user.

16. The hair comb of claim 14 further includes first and seconds guide elements formed respectively on the gripping member and the main body, wherein said first and second guide elements cooperate to guide the gripping member as it moves from the inoperative position to the clamping position.

17. The hair of claim 16 wherein the first guide element comprises a groove formed in a gripping tooth, and wherein the second guide element comprise a guide rib formed in the main body, said guide rib being received in the groove one the gripping tooth.

18. The hair comb of claim 14 wherein the latch includes a plurality of detents to releasably lock the gripping members in a plurality of different positions.

* * * * *